US005174770A

United States Patent [19]

Sasaki et al.

[11] Patent Number: 5,174,770

[45] Date of Patent: Dec. 29, 1992

[54] MULTICONTACT CONNECTOR FOR SIGNAL TRANSMISSION

[75] Inventors: Takinori Sasaki, Kawasaki; Yukiharu Tayama, Tokyo, both of Japan

[73] Assignee: AMP Incorporated, Harrisburg, Pa.

[21] Appl. No.: 794,760

[22] Filed: Nov. 15, 1991

[30] Foreign Application Priority Data

Nov. 15, 1990 [JP] Japan ..... 2-309461

[51] Int. Cl.[5] ..... H01R 13/648

[52] U.S. Cl. ..... 439/108; 439/607

[58] Field of Search ..... 439/95, 108, 607-610, 439/497

[56] References Cited

U.S. PATENT DOCUMENTS 4,897,046 1/1990 Tengler et al. ..... 439/610 X 4,975,084 12/1990 Fedder et al. ..... 439/608

4,976,628 12/1990 Fedder ..... 439/101

*Primary Examiner*—Eugene F. Desmond

*Attorney, Agent, or Firm*—Adrian J. LaRue; John R. Hopkins

[57] ABSTRACT

A multiple contact electrical connector for transmission of electrical signals therethrough comprises first and second matable connectors (1,2) each including signal contacts (5,5') and ground contacts (6,6') secured in dielectric housings (3,3') and arranged in a two-dimensional manner therein. The signal contacts (5,5') and the ground contacts (6,6') are arranged in the housings (3,3') in rows spaced at regular intervals with the ground contacts being shifted half a pitch relative to the signal contacts so that when the matable connectors are mated together, the engaged signal contacts (5,5') are surrounded by the engaged ground contacts (6,6').

5 Claims, 8 Drawing Sheets

MULTICONTACT CONNECTOR FOR SIGNAL TRANSMISSION

FIELD OF THE INVENTION

This invention relates to multicontact electrical connectors for signal transmission having two halves, each one having a number of contacts for signal transmission and contacts for grounding arranged in a two-dimensional manner.

BACKGROUND OF THE INVENTION

In many cases when it is required to interconnect processing equipment used for the integration and control of signals transmitted from a number of terminals for example, in the case of the interconnection of the signal integration and control equipment of a telephone circuit with similar equipment for signal integration and control of a telephone exchange, connectors including two halves each comprising a number of contacts for signal transmission and contacts for grounding arranged in a two-dimensional manner (referred to below as multicontact connectors for signal transmission) are used. The advantage presented by such multicontact connectors for signal transmission consists in the fact that they facilitate the increase in the number of signal circuits when required.

Since the connection of signal circuits involves the connection of the coaxial cables associated with each individual circuit, it is desirable that the grounding conductor shield the signal conductor. However, if such connections were made by means of connectors, to provide shielding for each individual contact would result in a substantial increase in the dimension of the connectors, to say nothing of the fact that it would also pose complex engineering problems.

Conventional multicontact connectors for signal transmission with a large number of contacts the engaging portions of which have the shape of, for example, a socket and a pin, or a male tab and female receptacle and which are arranged at a high density are known in the art.

However, the designers of conventional multicontact connectors for signal transmission have concentrated on increasing the density of signal contacts, while ignoring the arrangement of the grounding contacts. As a result, the cross-talk generated between the engaging portions of the contacts has been a wide spread phenomenon.

SUMMARY OF THE INVENTION

The purpose of this invention is to offer a multicontact connector for signal transmission in which the possibility of cross-talk is reduced due to the arrangement and configuration of the engagement portions of the signal contacts and grounding contacts.

In order to solve the problem mentioned above, the multicontact connector for signal transmission in accordance with this invention is characterized by the fact that it consists of two halves each one having signal contacts and grounding contacts arranged in rows at fixed intervals, with the signal contacts being placed in a zig-zag pattern relative to the grounding contacts at half the pitch of the latter; the grounding contacts of the connector halves have a roughly rectangular cross section so that when engaged with a matching contact the cross section of the engaged portions of the contacts becomes shaped, for example, like a cross; and the signal contacts are practically surrounded by the adjacent grounding contacts when the mating halves of the connector are engaged.

The multicontact connector for signal transmission in accordance with this invention has a number of signal contacts and approximately the same number of grounding contacts with the grounding contacts having a cross section of such a configuration that it assumes the shape, for example, of a cross when the contact is engaged with the matching counterpart. The signal contacts and grounding contacts are arranged in such a fashion that the grounding contacts practically surround the signal contacts when the connector halves are engaged, thus effectively shielding them. As a result, the phenomenon of cross-talk between the signal contacts typical of conventional connectors is greatly reduced.

BRIEF DESCRIPTION OF THE DRAWINGS

The invention is best understood by way of example with reference to the following detailed description thereof in conjunction with the accompanying drawings.

DETAILED DESCRIPTION OF THE INVENTION

A detailed explanation follows, of the multicontact connector for signal transmission in accordance with this invention based on its embodiments.

The multicontact connector MCC for signal transmission in accordance with this invention includes a first half and a second half.

Figure 1A:
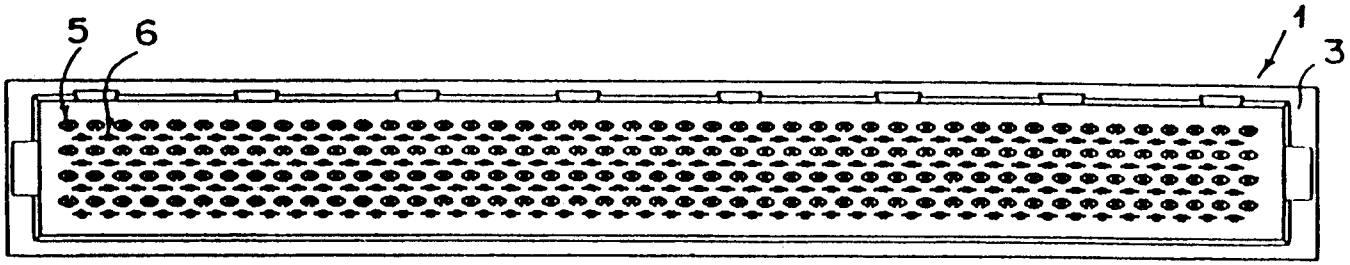
FIG. 1A is a front elevational view of a first half of a multicontact connector for signal transmission in accordance with this invention.
Figure 1B:
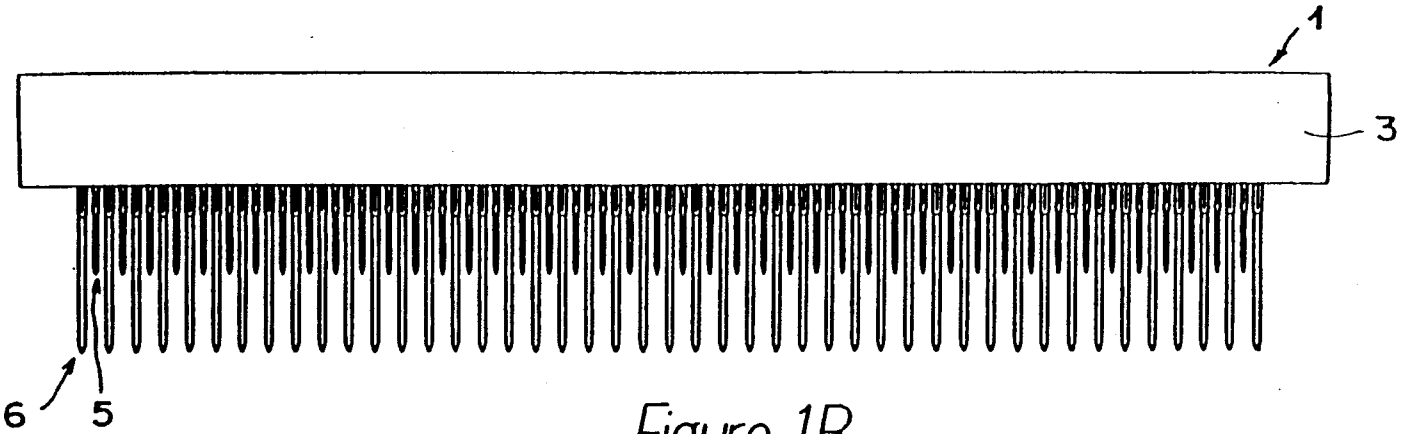
FIG. 1B is a top plan view of the connector of FIG. 1A.
Figure 1D:
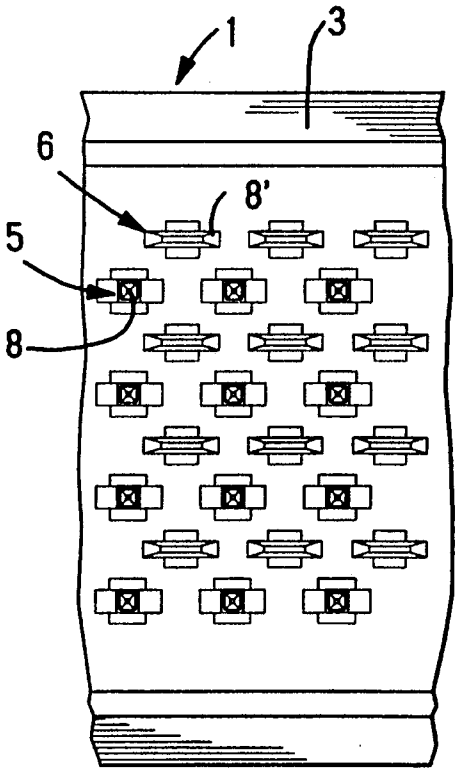
FIG. 1D is an enlarged part frontal view of FIGS. 1A.
Figure 1C:
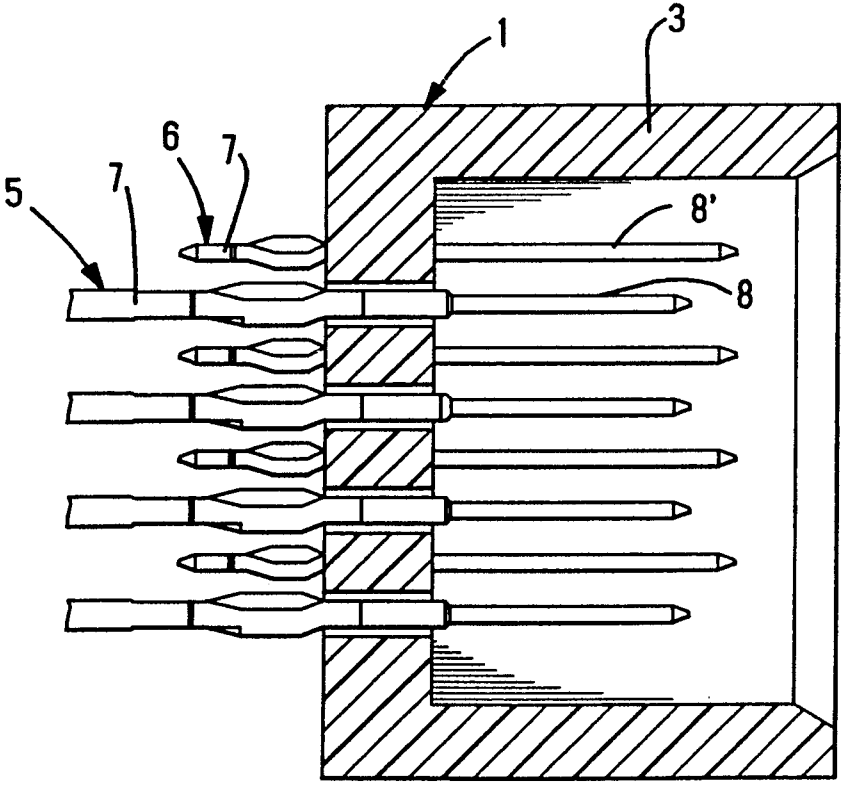
FIG. 1C is a cross-sectional view of FIG. 1A.
Figure 2C:
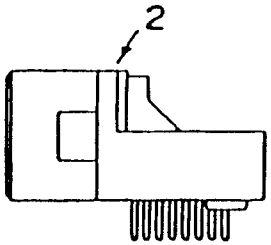
FIG. 2C is a side view of FIG. 2B.
Figure 2A:
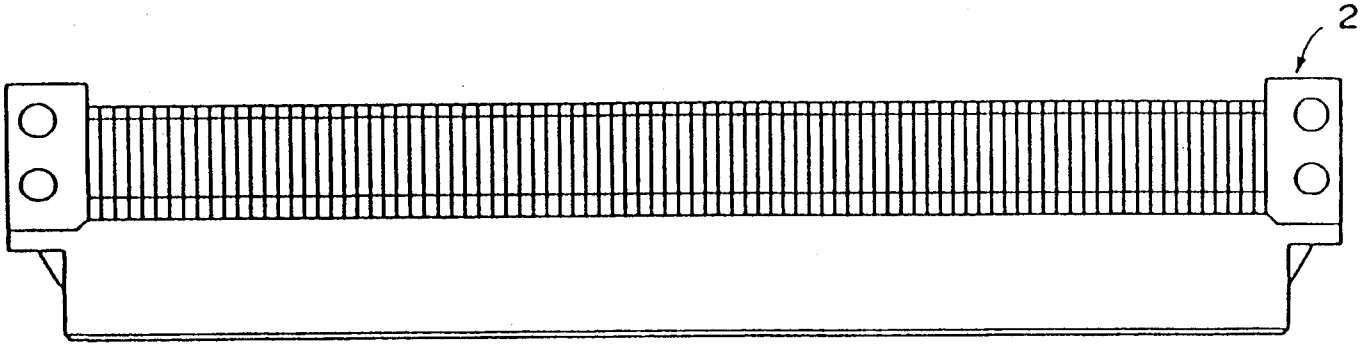
FIG. 2A is a bottom plan view of a second half of the connector.
Figure 2B:
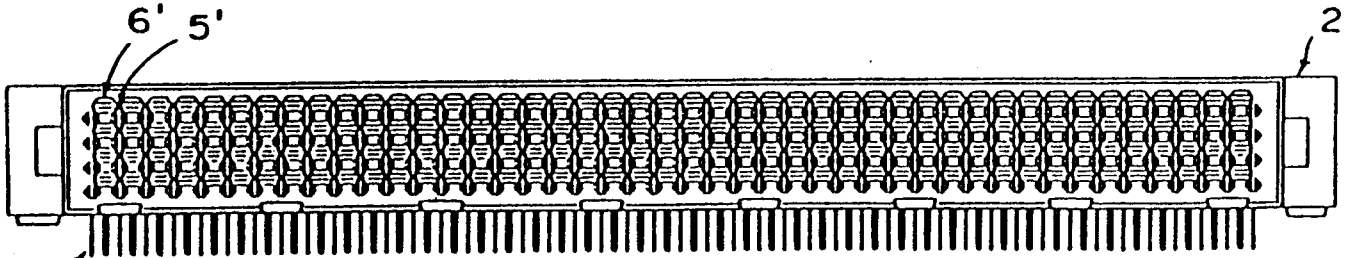
FIG. 2B is a front elevational view of the connector of FIG. 2A.
Figure 3:
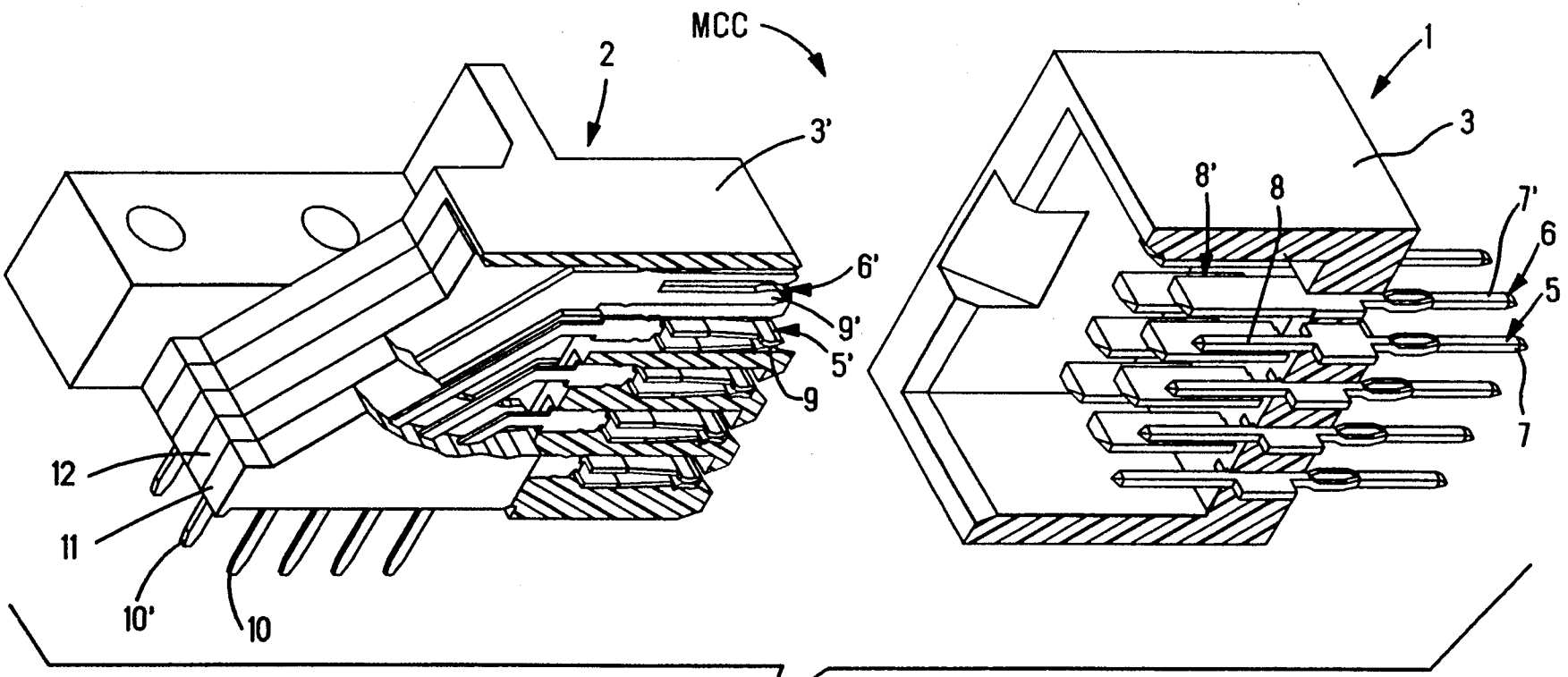
FIG. 3 is an exploded perspective view partly in section of the connector halves.

As can be seen from FIG. 3, the first half 1 comprises an insulating housing 3 made in the shape of a box having a number of signal contacts 5 and an approximately similar number of grounding contacts 6 secured in a base of the box-shaped housing 3. All signal contacts 5 and grounding contacts 6 have terminal portions, 7 and 7' respectively, which are used to connect with the signal and grounding conductors of the printed circuit boards of the equipment on the one side of the base, and the contact portions 8 and 8' connected to such terminal portions, on the other side of the base within the box-shaped housing. As seen from FIGS. 1A through 1D, the signal contacts 5 and grounding contacts 6 are arranged at roughly fixed intervals in an overlapping pattern with a deviation of a half pitch. As can be clearly seen from FIG. 3, the contact portion 8 of the signal contact 5 is configured as a pin, whereas the contact portion 8' of the grounding contact 6 is configured as a tab.

On the other hand, the second half 2 of the connector MCC, as shown explicitly in FIG. 3, includes the insulating housing 3' which contains a number of signal contacts 5' and approximately the same number of grounding contact 6'. All signal contacts 5' and grounding contacts 6' have receptacle contact portions, 9 and 9', for the receipt of contact portions 8, 8' of the signal contacts 5 and grounding contacts 6 of the first half 1 of the connector. At the other end of the contacts 5', 6' the terminal portions 10 and 10' are connected to the receptacle contact portions 9, 9'. The terminal portions 10 and 10' connect the signal and grounding conductors of the printed boards of the equipment on the other side. All signal contacts 5 and grounding contacts 6 of the first half 1 of the connector, and signal contacts 5' and grounding contacts 6' of the second half 2 of the connector are arranged at set intervals and are shifted at a half pitch relative to each other. In addition, as can be clearly seen from FIG. 3, the receptacle contact portions 9 of the signal contacts 5' exhibit a roughly C-shaped configuration, whereas the receptacle contact portions 9' of the grounding contacts 6' have a fork shape.

Figure 3B:
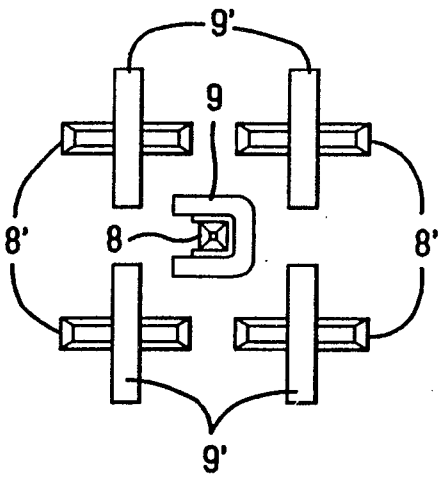
FIG. 3B is a frontal view showing engaged ground contacts surrounding engaged signal contacts.
Figure 3A:
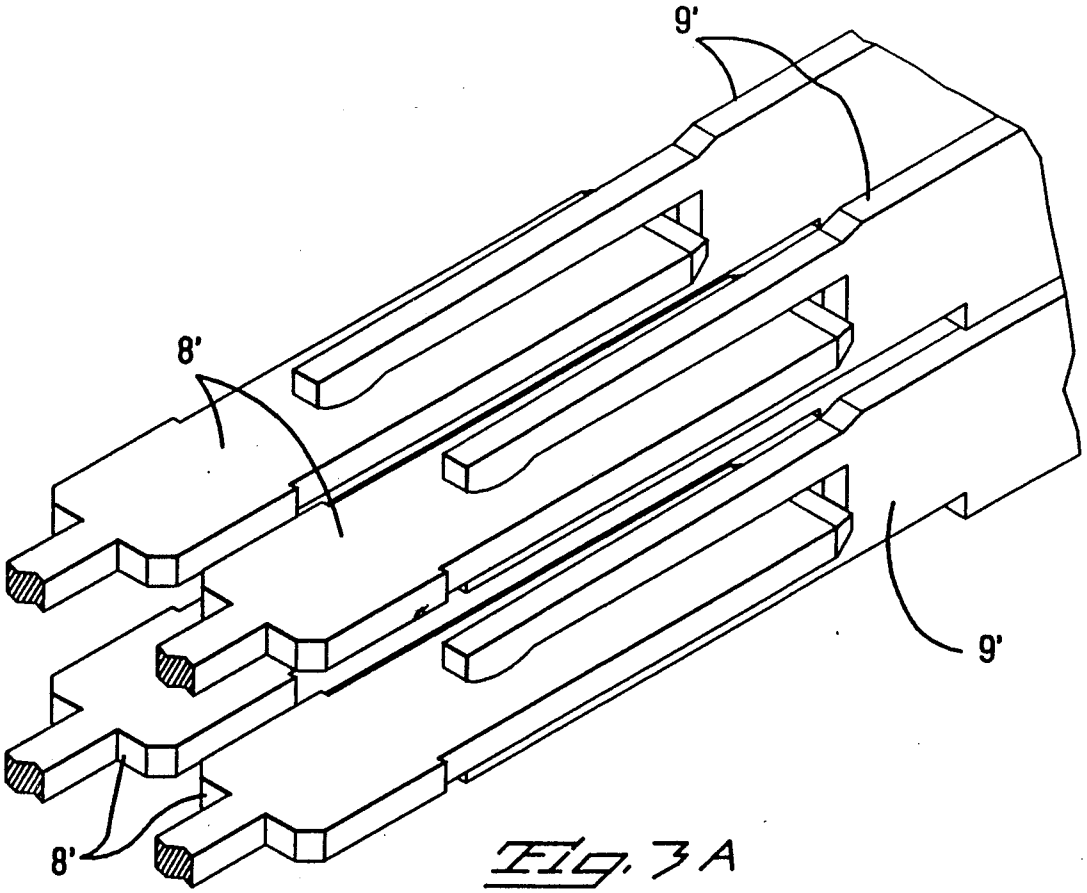
FIG. 3A is a perspective view showing ground contacts in engagement.

When the first half 1 and the second half 2 of the connector MCC are mated, as can be seen from FIG. 3A, the contact tabs 8' of the grounding contacts 6 of the first half 1 and the receptacle contact portions 9' of the grounding contacts 6' of the second half 2 are directly connected with each other. At the same time, the contact portions 8 of the signal contacts 5 of the first half 1 and the receptacle contact portions 9 of the signal contacts 5' of the second half become mutually engaged.

Figure 3C:
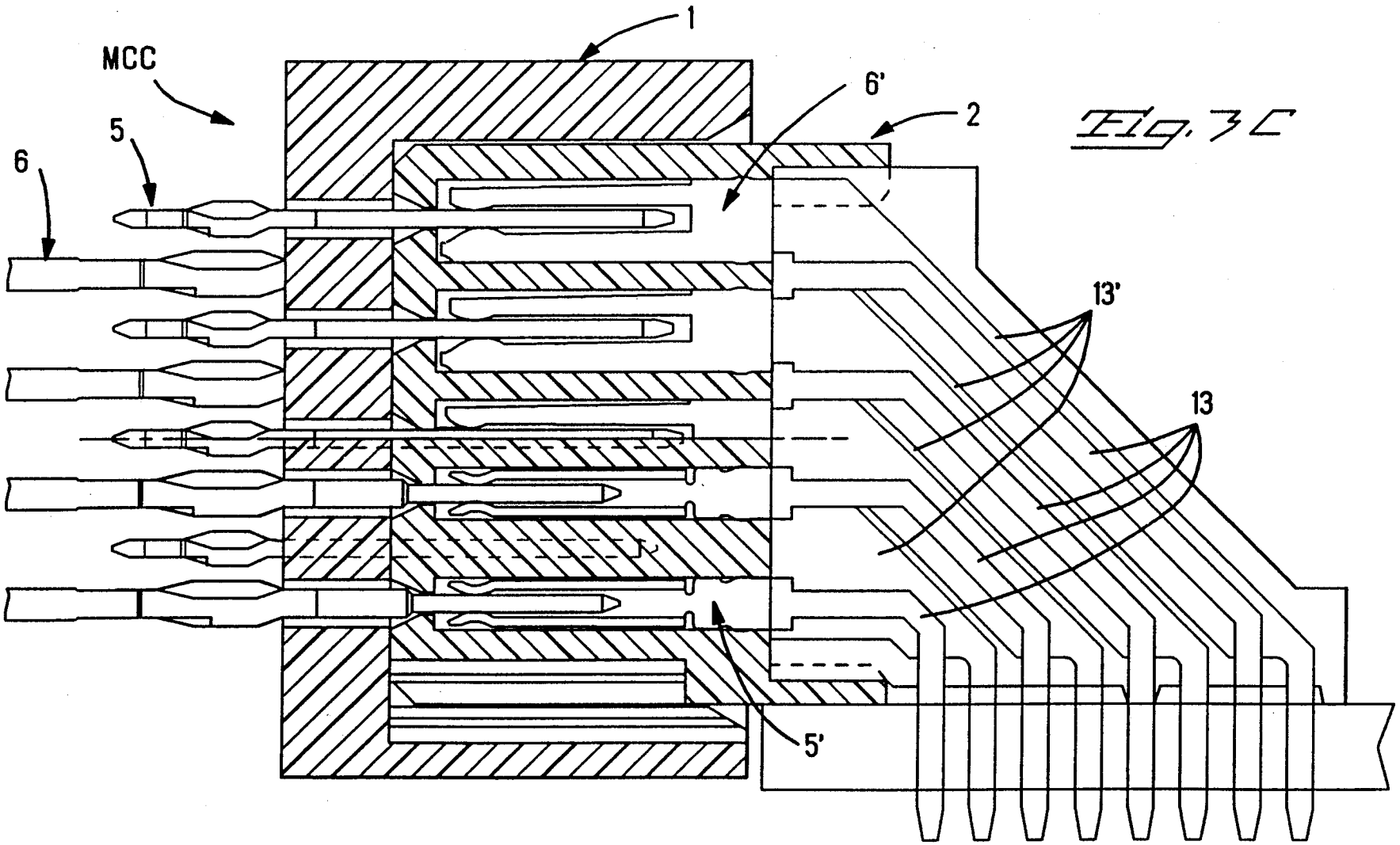
FIG. 3C is a cross-sectional view of the connector halves in matable engagement.

In this state, as shown in FIGS. 3B and 3C, the direct engagement of the contact tabs 8' of the grounding contacts 6 of the first half 1 with the grounding contact 6' of the second half 2 (referred to below as "the engagement of the grounding contacts"), and the engagement of the contact pins 8 of the signal contacts 5 of the first half 1 of the connector with the receptacle contact portions 9 of the signal contacts 5' of the second half 2 (referred to below as "the engagement of the signal contacts") results in such a positional relationship of the entire set of engaged contacts that the signal contacts are surrounded by grounding contacts. Moreover, as shown in FIG. 3, the engagement of contact tabs 8' and contact portions 9 result in a cross-shape configuration.

Therefore, the engaged portions of the signal contacts are virtually shielded by the engaged portions of the grounding contacts, thus reducing considerably the eventuality of the cross-talk which is generated in the conventional connectors.

In what follows, additional features specific of both the signal contacts 5' and grounding contacts 6' of the second half 2 of the connector in accordance with this embodiment will be explained which are generated by the manufacturing method and configuration thereof.

Figure 4:
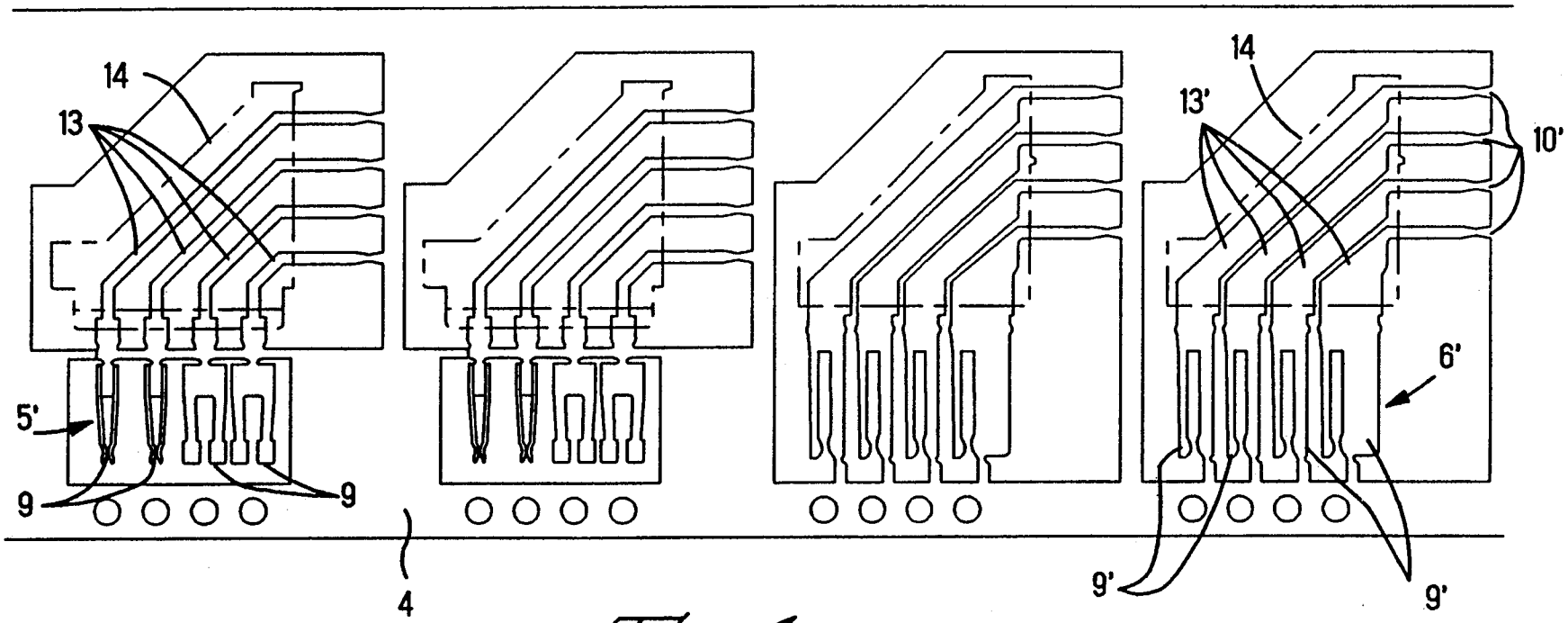
FIG. 4 is a plan view showing the manufacturing stages of the signal and ground contacts of the second half of the connector.
Figure 6B:
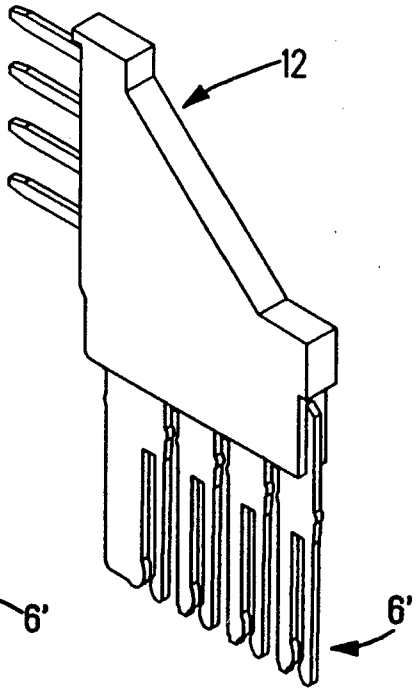
FIGS. 6A and 6B are perspective views of a ground contact block.
Figure 6A:
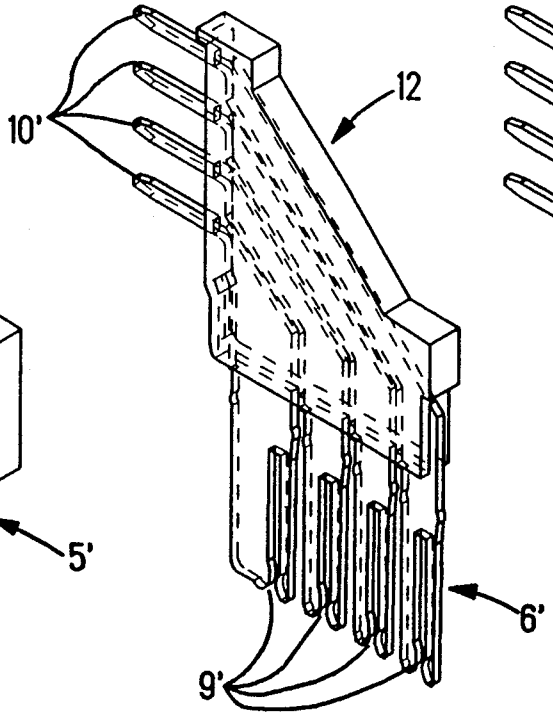
Figure 5B:
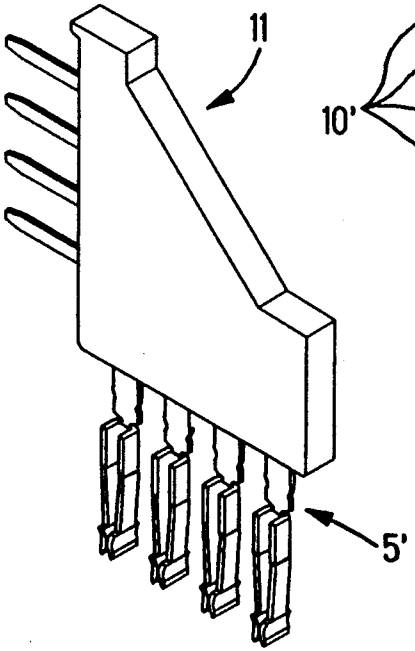
FIGS. 5A and 5B are perspective views of a signal contact block.
Figure 5A:
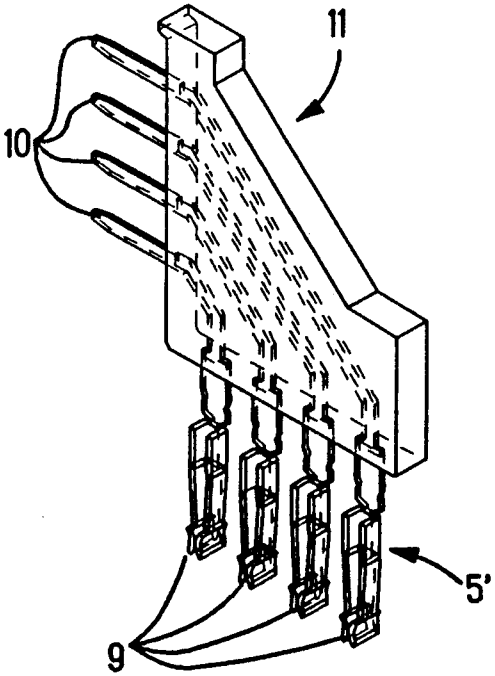

FIG. 4 represents a plan view displaying the various stages in the process of manufacturing the signal and grounding contacts of the second half of the connector: FIGS. 5A and 5B are perspective views of a signal contact block or module; and FIGS. 6A and 6B are perspective views of a grounding contact block or module.

As shown in FIG. 4, all signal contacts 5' and grounding contacts 6' of the second half 2 of the connector in accordance with this embodiment, are formed by stamping from a sheet of conductive metal 4. The signal contacts 5' and the grounding contacts 6' are stamped in units of four contacts, whereas the portion 14 shown by a dotted line is subject to insert-molding thereby molding a suitable dielectric material onto connecting sections 13,13'. The signal contact blocks 11 and the grounding contact blocks 12 are formed in stages as shown in FIGS. 5A through 6B. Then, the signal contact blocks 11 and the grounding contact blocks 12 are inserted alternately in the insulating housing 3' as shown in FIG. 3.

This insert-molding process of the signal contacts 5' and grounding contacts 6' by blocks of four units yields the following result.

In the first place, knowing that the internal impedance of the signal contacts 5' can be altered by altering the dielectric constant of the resin used in insert molding the impedance will be easily brought to a predetermined value. By adjusting the impedance, the noise can be reduced. In addition, since all the signal contacts 5' and grounding contacts 6' have dielectric material insertmolded thereon, the intervals between the contact can be made with great precision, thus providing for a highly-uniform spacing and impedance of the contacts. Since the contacts are produced in blocks, the handling and assembly of the second half 2 of the connector is greatly facilitated.

As FIG. 4 shows in this embodiment, the oblique connecting sections 13' located between the receptacle contact portions 9, and the terminal sections 10' of the grounding contacts 6' are wider than the connecting sections 13 of the signal contacts 5'. In addition, when the signal contact blocks 11 and the grounding contact blocks 12 are alternately inserted into the insulating housing 3', connecting sections 13' of the signal contacts 5' will be between the connecting sections 13' of the grounding contacts 6' as shown in FIGS. 3 and 3C.

Thanks to this arrangement, the signal contacts 5' are shielded by the grounding contacts 6' in the area of their connecting sections as well, thus again reducing the possibility of cross-talk generation. In addition, due to the fact that the connection sections 13' of the grounding contacts 6' are wide, the distance between the terminal sections 10' and the receptacle contact portions 9' is shortened, thereby preventing any potential variations in the grounding contacts 6'.

The above descriptions concerning the details and effects of the multiplecontact connector on signal transmission in accordance with this invention have been based on the disclosed embodiment only. However, the multiplecontact connectors for signal transmission in accordance with this invention are not limited only to this embodiment.

For example, as regards the signal contacts 5' and the grounding contacts 6' of the second half 2 of the connector in accordance with the above embodiment, the emphasis is placed on the engaging sections of the signal contacts and grounding contacts of the first and second halves, but this invention is not limited to this arrangement only.

In addition, in the above embodiment, the contact portion 8' of grounding contact 6 of the first half 1 of the connector is made in the shape of a tab and the receptacle contact portion 9' of the grounding contact 6' of the second half 2 of the connector is made in the shaped of a fork, but these configurations are interchangeable.

Therefore, the multiple contact connectors for signal transmission in accordance with this invention can be executed with various modifications without sacrificing its effect.

We claim:

1. An electrical connector for interconnecting multiple signal contacts to reduce cross-talk of signals carried by said contacts, including first and second housings adapted to intermate along a given axis, each housing having an array of signal and ground contacts extending along an axis parallel to the given axis with the signal and ground contacts of the second housing having post contact portions of a given length and with the signal and ground contacts of the second housing having spring portions of a given length mounted on centers so that the signal contacts of the first housing intermate with the signal contacts of the second housing, and the ground contacts of the first housing intermate with the ground contacts of the second housing, each of the said ground contacts having a width substantially greater than the width of a signal contact, and with the ground contacts of the first housing oriented transversely to the ground contacts of the second housing to define a grounding structure extending substantially between any two adjacent signal contacts to provide reduced cross-talk therebetween.

2. The connector of claim 1 wherein said ground contacts in said first housing have a blade configuration with a width considerably wider than the thickness and said ground contacts of said second housing having a split blade defining said spring portion adapted to receive the blade configuration of the ground contacts of the first housing inserted therewithin to provide a mated cross-sectional configuration in the form of a cross forming said structure.

3. The connector of claim 1 wherein the said ground contacts of the second housing including the split blade portion are of a length extending substantially along the portion of said given length to provide a grounding structure extending substantially along the given length of the mated signal contacts.

4. The connector of claim 1 wherein the said signal and ground contacts of the first housing are mounted in a one-piece dielectric housing on said centers and the signal and ground contacts of the second housing are separately mounted in subsets in a sub-housing with said sub-housing stacked together to form the second housing and with the said ground contacts on said centers.

5. An electrical connector for interconnecting multiple signal and ground paths to minimize cross-talk between signal paths including first and second dielectric housings intermatable along a given axis, the first housing including signal contacts mounted in first rows to define an array extending in length parallel to the said mating axis on given centers and a second housing including multiple second signal contact mounted in rows extending in an array on said given centers with the first and second signal contacts having a given length and intermating portions to interconnect signal paths between said housings, the first housing further including an array of first blade contact each of a width substantially greater than the width of a signal contact and mounted on said centers to extend in rows parallel to the rows of the signal contacts and the second housing further including an array of second blade contacts each of a width substantially greater than the width of a signal contact mounted on said centers to extend in rows perpendicular to the rows of the said signal contacts with each second blade contact having a split of a length equal to the given portion of the length of the spring portions and parallel to said given axis to receive and interconnect the first blade contacts inserted within the split during mating of the first and second housings with the first and second blade contacts forming a grounding structure extending substantially between adjacent signal contacts.

* * * * *

UNITED STATES PATENT AND TRADEMARK OFFICE

CERTIFICATE OF CORRECTION

PATENT NO. : 5,174,770

DATED : December 29, 1992

INVENTOR(S) : Takinori Sasaki, et al

It is certified that error appears in the above-identified patent and that said Letters Patent is hereby corrected as shown below:

On the title page,
Item [73] Assignee: AMP Incorporated, Harrisburg, Pennsylvania, and NEC Corporation, Tokyo, Japan Signed and Sealed this Eighteenth Day of October, 1994

*Attest:*

*Attesting Officer*

BRUCE LEHMAN

*Commissioner of Patents and Trademarks*